United States Patent [19]

Griffiths

[11] Patent Number: 4,587,772

[45] **Date of Patent: * May 13, 1986**

[54] DISPENSER FOR A JET OF LIQUID BEARING PARTICULATE ABRASIVE MATERIAL

[75] Inventor: Norman J. Griffiths, Shelton Lock, England

[73] Assignee: National Research Development Corporation, London, England

[ * ] Notice: The portion of the term of this patent subsequent to May 22, 2001 has been disclaimed.

[21] Appl. No.: 587,021

[22] Filed: Mar. 6, 1984

Related U.S. Application Data

[63] Continuation of Ser. No. 263,324, May 13, 1981, Pat. No. 4,449,332, which is a continuation of Ser. No. 62,570, Jul. 31, 1979, abandoned.

[51] Int. Cl.[4] ..... B24C 5/04

[52] U.S. Cl. ..... 51/439; 239/314

[58] Field of Search ..... 51/439, 410, 319–320; 239/314, 318, 596

[56] References Cited

U.S. PATENT DOCUMENTS 4,449,332 5/1984 Griffiths ..... 51/439

*Primary Examiner*—Frederick R. Schmidt
*Assistant Examiner*—Robert A. Rose
*Attorney, Agent, or Firm*—Cushman, Darby & Cushman

[57] ABSTRACT

A nozzle holder, carrying at least one inlet nozzle is mounted within the bore of a hollow body between a liquid inlet and abutment.

The or each inlet nozzle is dimensioned and arranged so that the radial cross-section of the flow of liquid through a mixing chamber between the nozzle holder and outlet (16, 17) at the other end of the bore from the liquid inlet is smaller than the cross-section of the mixing chamber.

Particulate abrasive material is therefore sucked into the mixing chamber, where it mixes with the liquid, through passages which extend through the hollow body along axes which are convergent with the axis of liquid flow through the mixing chamber.

9 Claims, 4 Drawing Figures

DISPENSER FOR A JET OF LIQUID BEARING PARTICULATE ABRASIVE MATERIAL

This is a continuation of application Ser. No. 263,324, filed May 13, 1981, now U.S. Pat. No. 4,449,332, which itself is a continuation of Ser. No. 62,570 filed July 31, 1979, now abandoned.

TECHNICAL FIELD OF THE INVENTION

The invention relates to a dispenser, for a jet of liquid bearing particulate abrasive material, which can be used for cutting or cleaning.

BACKGROUND ART

Although it is known to employ a jet liquid, such as water, bearing a suspension of particulate abrasive material for cutting and cleaning purposes, this technique is not entirely satisfactory because of the limitations of the apparatus hitherto employed.

In the known apparatus, a dispenser for a jet of liquid bearing particulate abrasive material comprises a hollow body defining a bore, liquid inlet means at one end of the bore, outlet means at the other end of the bore for discharging liquid bearing particulate abrasive material, a mixing chamber disposed between the liquid inlet means and the outlet means, a supply chamber for the particulate material, and passage means for transferring the particulate material from the supply chamber to the mixing chamber. Thus when it is necessary to use a jet of liquid bearing particular abrasive material for cutting purposes, mixing of the particulate abrasive material with the pressurised liquid has been found to result in a considerable reduction in pressure of the pressurised liquid. Further it it difficult to provide a cohesive, parallel-sided jet and, as the abrasive material is only drawn onto one side of the jet, the jet is not stable and the cut is uneven, biased to one side where the majority of the abrasive material is concentrated. Conversely, where the jet of liquid bearing particulate abrasive material is to be used for cleaning purposes, in spite of the fact that a divergent jet is advantageous in this application, there is still too much pressure loss in the pressurised liquid as a result of the mixing of the particulate abrasive material with the liquid. Moreover, in spite of this excessive pressure loss, it has been found that the particulate abrasive material is not sufficiently uniformly suspended in the liquid. As it is common practice in most cleaning heads for the liquid inlet means to comprise a plurality of water inlets arranged around a single central inlet for the abrasive material, the abrasive material forms a narrow efficient cleaning core, but this effect diminishes in the radially outer parts of the jet where the abrasive material is less concentrated.

DISCLOSURE OF THE INVENTION

It is an object of the present invention to provide a dispenser for a jet of liquid bearing particulate abrasive material in which the pressure loss occurring as a result of the mixing of the particulate abrasive material with the liquid is reduced so that pressure energy supplied to the liquid is more effectively utilised in cutting and cleaning operations performed by the jet.

According to the invention, there is provided a dispenser, for a jet of liquid bearing particulate abrasive material, comprising a hollow body defining a bore; abutment means within the bore and facing one end of the bore; a nozzle holder seated against the abutment means; liquid inlet means at said one end of the bore; outlet means at the other end of the bore; for discharging liquid bearing particulate abrasive material; a mixing chamber disposed between the nozzle holder and the outlet means; a supply chamber, for particulate abrasive material; a plurality of passages, for the particulate abrasive material, respectively extending from the supply chamber to the mixing chamber along axes which are convergent with a central axis extending through the mixing chamber from said one end of the bore to said other end; and at least one inlet nozzle mounted in the nozzle holder for directing a flow of liquid through the mixing chamber, the or each inlet nozzle being dimensioned and arranged, in relation to the mixing chamber and the passages for the particulate abrasive material, so that the radial cross-section of the flow of liquid through the mixing chamber is smaller than the cross-section of the mixing chamber and the particulate abrasive material issuing from the passages enters the mixing chamber at points which are radially spaced from said flow of liquid.

Thus, the flow of liquid through the mixing chamber causes a reduction of pressure within the mixing chamber, in accordance with the jet-pump principle and this reduction in pressure draws the particulate abrasive material into the mixing chamber. However, the reduction in pressure of the liquid passing through the mixing chamber is accompanied by an increase in kinetic energy and only a relatively small amount of energy is dissipated as a result of the particulate abrasive material being drawn into the fluid flow through the mixing chamber.

In a preferred embodiment, the liquid inlet means and the nozzle holder co-operate with each other to define a high pressure liquid inlet chamber capable of withstanding liquid pressures of between 10,000 p.s.i. and 50,000 p.s.i., or even higher, and the nozzle holder is clamped between the liquid inlet means and the abutment means so as to prevent leakage of liquid from the liquid inlet chamber around the nozzle holder. In operation, the liquid passed through the dispenser is energised at a rate of 150 horsepower. However, the rate of energisation of the liquid may be as high as 300 horsepower and above. In this case the nozzle apertures may need to be scaled up or down to suit the output of particular pumps.

Where the jet of particulate abrasive material is to be used for cutting purposes, it is desirable that the jet issues from the dispenser as a cohesive, parallel-sided jet. One way of obtaining this effect is to add a long chain polymer material such as polyethylene oxide to the liquid to improve jet stability, where the cost of this expedient is justified. It is also desirable that the particulate abrasive material is entrained in the outer peripheral layer of this jet. This means that the abrasive material is used more efficiently than abrasive material from dispensers in which the particulate abrasive material is more uniformally mixed with the liquid forming the jet. This resultant economy in the use of particulate material can be achieved by arranging the or each inlet nozzle so as to direct liquid along an axis which is parallel to a reference axis which, itself, is parallel to the central axis through the mixing chamber and by providing outlet means comprising a convergent flow restrictor and an outlet nozzle of uniform cross-section. Thus, in a preferred form of dispenser for this purpose, using a single inlet nozzle, this nozzle is arranged to direct liquid along the central axis through the mixing chamber.

Even greater economy can be achieved by providing controllable supply means for metering the feed of particulate abrasive material to the supply chamber. It is therefore possible to use more expensive, harder abrasive material such as aluminium oxide, silicon carbide and olivine. Typically, where the abrasive material is dry mansel sand which is entrained in a water flow of 15 Imperial gallons per minute, pressurised to 10,000 p.s.i., the supply means are controlled so that the abrasive material is fed at a rate of up to 12 lbs per minute. For other abrasive material the amount would vary according to its density and specific grain size.

On the other hand, where the jet of liquid bearing particulate abrasive is to be used for cleaning purposes, it is desirable that the jet which issues from the dispenser is divergent and that particulate abrasive material is mixed with the liquid in an even, steady and homogeneous manner. This can be achieved by providing a nozzle holder having a plurality of inlet nozzles and, particularly when working with heavier abrasive materials such as silicon carbide, these inlet nozzles may be arranged so as to direct liquid along intersecting axes which are angularly inclined, in the same sense, to radial planes containing the central axis through the mixing chamber so that a swirling or rotational component is imparted to the fluid flow to provide more thorough mixing of the particulate material and to provide the required divergent jet and by providing locking means for preventing rotation of the nozzle holder.

In a typical construction, in which the outlet means have an outlet diameter of one-and-a-quarter inches. the axes of the inlet nozzles intersect with each other at a distance of two to four inches from the nozzle holder. Clearly the disposition of this point of intersection will vary in dependence on the output of the apparatus. For higher powered units the point of intersection will be closer to the nozzle holder and the jet issuing from the outlet means will be wider. In this case, it would be advantageous to feed the abrasive material at a higher rate.

To improve the mixing of the particulate abrasive material in the liquid, the passages extending from the supply chamber to the mixing chamber and the inlet nozzle are both equiangularly spaced around the central axis of the mixing chamber and the passages for the particulate abrasive material and the inlet nozzles are centred on angularly spaced radial planes containing the central axis of the mixing chamber. Thus, where the number of passages for the particulate material is the same as the number of inlet nozzles, the angular space in between each passage for the particulate abrasive material and one of the inlet nozzles is the same as the angular spacing between each other passage and one of the inlet nozzles. The flow from each inlet nozzle can thus be optionally directed along an axis which intersects with the axis of one of the passages so as to enhance the mixing effect of the swirling fluid flow.

Two embodiments of the invention are hereinafter described by way of example, with reference to the accompanying drawings in which like parts have been assigned the same reference numerals.

BEST MODES FOR CARRYING OUT THE INVENTION

Figure 1:
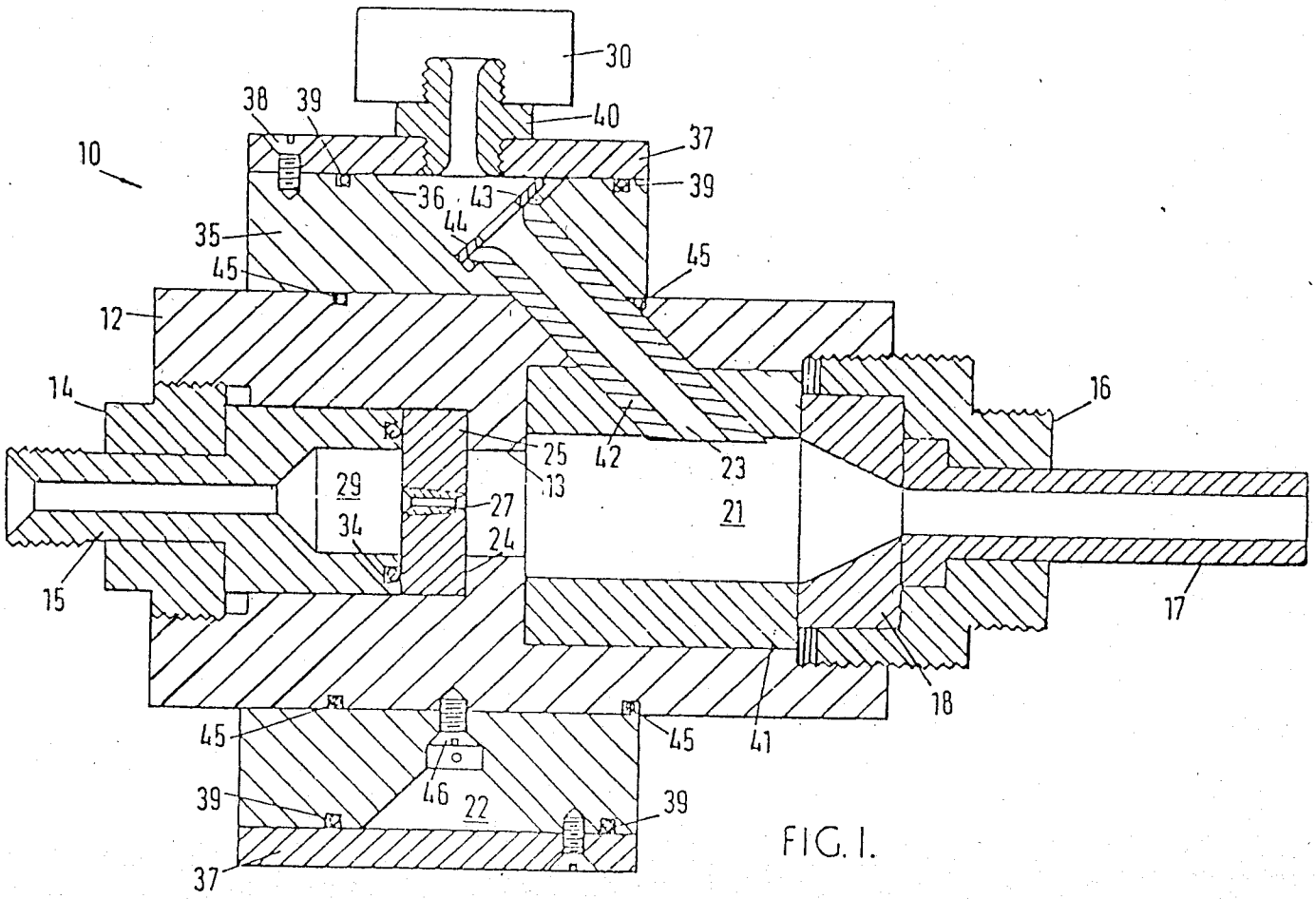
FIG. 1 is a schematic sectional elevation of a dispenser for providing a jet of liquid bearing particulate abrasive material for use in jet cutting operations.

The liquid jet cutting dispenser 10 shown in FIG. 1 comprises a hollow body 12 having a stepped bore 13. Liquid inlet means comprising a locknut 14 and an inlet union 15 are fitted to one end of the bore 13 and outlet means comprising a locknut 16, an outlet nozzle 17 of uniform cross-section and a convergent flow restrictor 18 are fitted to the other end of the stepped bore 13. A nozzle holder 25 is mounted within the stepped bore 13 between the inlet union 15 and abutment means provided by an internal shoulder 24 in the stepped bore 13. In practice, although not shown, for the sake of clarity, the nozzle holder 25 is clamped firmly between the inlet union 15 and the internal shoulder 24 to prevent leakage of high pressure water from the liquid inlet chamber 29 defined by the inlet union 15 and the nozzle holder 25. To further reduce leakage, an "O"-ring 34 of stainless steel or other similar noncorrosive material is mounted between the inlet union 15 and the nozzle holder 25.

An inlet nozzle 27 is mounted in the nozzle holder 25 so as to direct a high velocity jet of water along the central axis of a mixing chamber 21 disposed between the outlet means and the nozzle holder 25. This nozzle 27 terminates in a discharge end or tip which, as illustrated in FIG. 1, is located axially at the upstream end of the mixing chamber 21.

A ring member 35 formed with a circumferentially extending "V"-shaped groove 36 surrounds the hollow body 12 and a sleeve 37 is secured to the outside surface of the ring member 35 by means of screws 38 to define a supply chamber 22 for particulate abrasive material. "O"-rings 39 are mounted between the ring member 35 and the sleeve 37, on opposite sides of the "V"-shaped circumferentially extending groove 36 so as to seal the supply chamber 22.

Particulate abrasive material is fed into the supply chamber 22 at a metered rate by means of a controllable supply means 30 which is connected to the supply chamber 22 by means of a nipple 40 and this particulate abrasive material is drawn into the mixing chamber 21 from the supply chamber 22 along three equiangularly extending passages 23 (only one of which is shown). This withdrawal of particulate abrasive material from the supply chamber 22 is effected as a result of the reduction in pressure within the mixing chamber 21 due to the passage of a high-velocity water jet through the mixing chamber 21. As shown in FIG. 1, the downstream end of each passage 23 terminates in an entry opening formed in the cylindrical sidewall of the mixing chamber 21, which entry openings are located axially a substantial distance downstream from the discharge tip of nozzle 27.

To prevent undue wear, the mixing chamber 21 and the passages 23 are provided with wear-resistant liners 41 and 42 of a material such as tungsten carbide or hard rubber. As shown, each of the liners 42 is provided with a flanged end 43 and is locked in place by means of a circular spring clip 44 engaging with the flanged end 43. Finally, to prevent ingress of air into the apparatus between the hollow body 12 and ring member 35, two further "O"-rings 45 are mounted between these members on opposite sides of the passages 23 and the ring member 35 is held in place by means of screws 46.

The inlet nozzle 27 is formed of a wear-resistant material such as tungsten carbide or sapphire and of a form giving a discharge co-efficient as close to unity as possible. This inlet nozzle may be constructed and mounted as described in British Pat. No. 1,517,769. As a result, liquid issues from the inlet nozzle 27 in the form of a coherent parallel-sided jet which is directed through the convergent restrictor 18 into the outlet nozzle 17. The resultant reduction in pressure within the mixing chamber, in the angular-section space between the jet and the liner 41 causes particulate abrasive material to flow into the mixing chamber 21 through the passages 23. However, the particles of abrasive material are immediately entrained in the outer layer of the jet and, as a result of the stability of the jet, these particles remain concentrated in the outer layer, even when the jet issues from the outlet nozzle 17.

Figure 2:
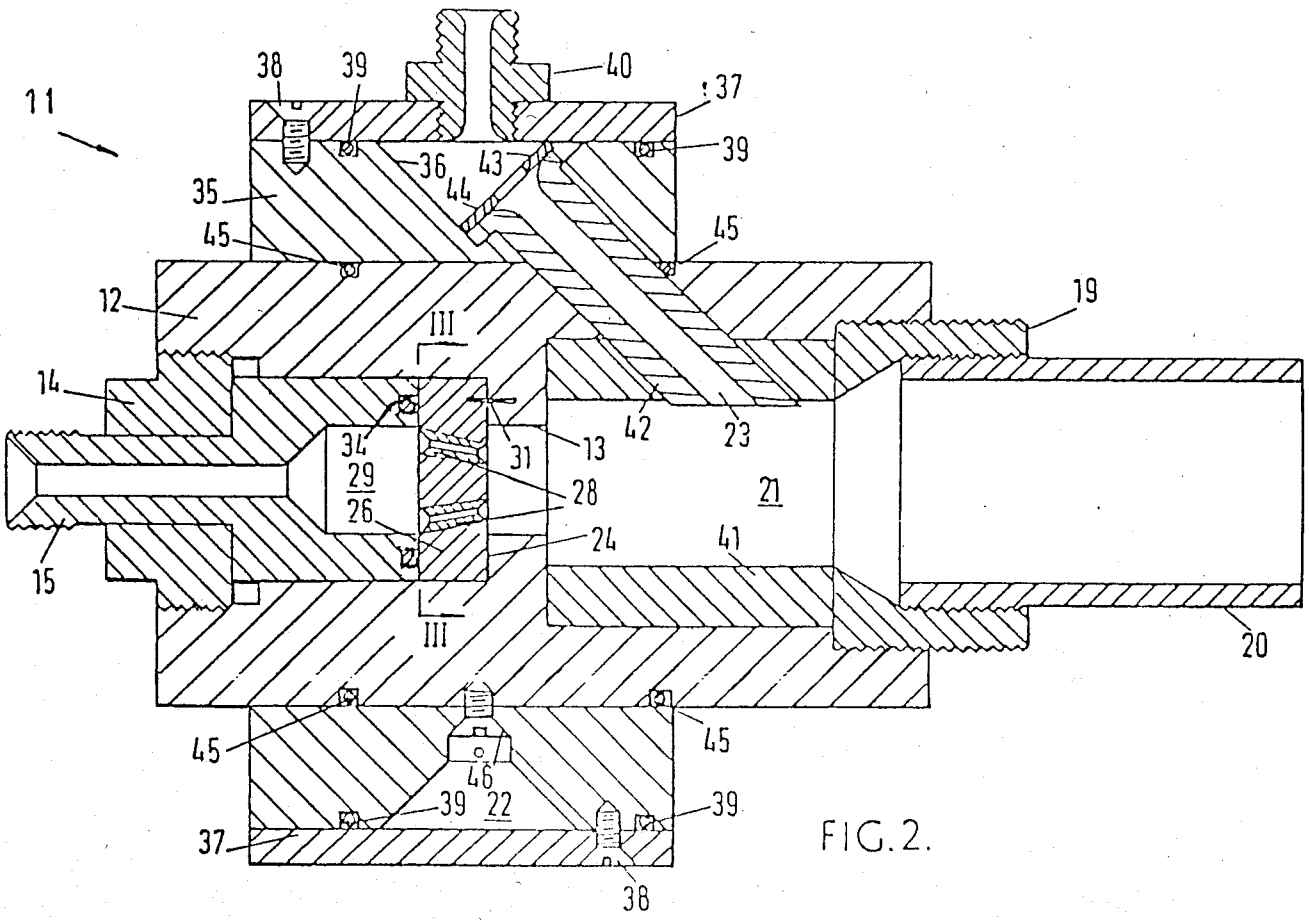
FIG. 2 is a schematic sectional side elevation of a dispenser for a jet of liquid bearing particulate abrasive material for use in liquid jet cleaning operations.
Figure 3:
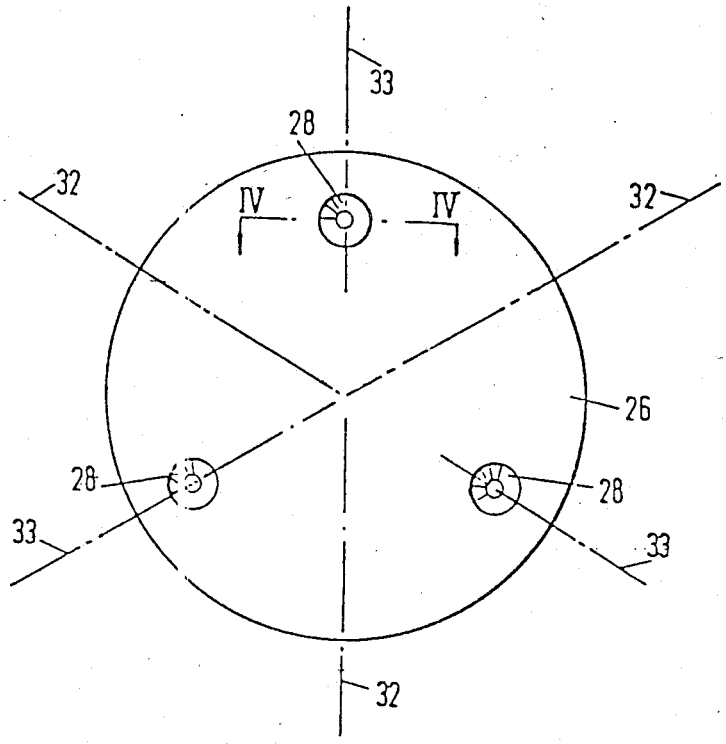
FIG. 3 is an end view taken across Section III—III in FIG. 2, showing an end view of a nozzle holder forming part of the apparatus shown in FIG. 2 and its orientation relative to other parts of the apparatus shown in FIG. 2.

In the modified form of apparatus shown in FIG. 2, for use as a liquid jet cleaning dispenser, a nozzle holder 26 is clamped between the inlet union 15 and the internal shoulder 24 but is also held against rotation by locking means in the form of a dowel pin 31. Moreover, in this construction, the nozzle holder 26 carries three inlet nozzles 28 which, as shown in FIG. 3, are equiangularly disposed about the central axis through the mixing chamber 21. In this case, the outlet means for discharging a liquid bearing a particulate abrasive material comprise a lock-nut 19 and outlet nozzle 20 of larger cross-section than the mixing chamber 21.

As shown in FIG. 2, the inlet nozzles 28 are aligned on axes which are inclined to the central axis of the mixing chamber 21 so as to direct liquid along intersecting axis, thus providing a divergent jet issuing from the outlet nozzle 20.

Figure 4:
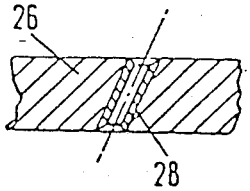
FIG. 4 is a sectional plan view taken across the Section IV—IV in FIG. 3 showing part of the nozzle holder shown in FIG. 3.

As shown in FIGS. 3 and 4, the radial planes 32 containing the central axis of the mixing chamber 21 and the axis of the passages 23 for the particulate abrasive material are equiangularly spaced and separated by angles of 120°. Similarly, the radial planes 33 containing the central axis of the mixing chamber 21 and on which the inlet nozzles 28 are centred are also equiangularly spaced and separated by angles of 120°. However, the planes 32 are inclined at an angle of 60° to the planes 33.

As shown in FIG. 4 the axes along which the inlet nozzles 28 are directed are also inclined to the planes 32 containing the central axis of the mixing chamber 21 and on which the inlet nozzles 28 are centred. The inlet nozzles 28 thus impart a swirling or rotational component to the flow of liquid through the mixing chamber, thus enhancing the mixing of the particulate abrasive material with the liquid.

This optional modification is of particular advantage for some uses of the apparatus.

I claim:

1. In a dispenser for a dispensing a jet of liquid bearing particulate abrasive material, comprising in combination:

a hollow body defining a bore, liquid inlet means at one end of the bore, outlet means at the other end of the bore for discharging the liquid bearing particulate abrasive material, a mixing chamber, larger in radial dimension than the outlet means, disposed between the liquid inlet means and the outlet means, abutment means provided within the bore, between said one end of the bore and the mixing chamber, so as to face said one end of the bore;

a nozzle holder seated against the abutment means, at least one inlet nozzle mounted in the nozzle holder for directing a flow of liquid through the mixing chamber along the first axis, said inlet nozzle being dimensioned and arranged so that, in use of the dispenser, the radial cross-section of the flow of liquid through the mixing chamber is smaller than the cross-section of the mixing chamber, said inlet nozzle having a discharge end lying within the mixing chamber at a fixed axial location relative to the direction of the flow of liquid, a controllable supply means for providing a metered feed of particulate abrasive material to a supply chamber, passage means for transferring the particulate material from the supply chamber to the mixing chamber and comprising at least three passages which are equally angularly disposed around said bore and which respectively extend along second axes which intersect with the direction of flow of the liquid at an angle that is between 0° and 90° with said second axis converging with the direction of the flow of the liquid, entry ports in the wall of the mixing chamber by which separate flows of particulate material leave the passages along said second axis and enter the mixing chamber, the entry ports defining and lying in a common plane transverse to the direction of flow of the liquid and lying at a second axial location relative to that direction and axially downstream relative to said first axial direction, said mixing chamber having a portion of substantial axial length as defined between said first and second axial locations wherein the flow of liquid directed by said inlet nozzle travels within the mixing chamber wherein no particulate material flows after entering the mixing chamber by way of the entry ports due to said entry ports being at the downstream axial end of said portion, and said first and second axes intersecting within said mixing chamber downstream of said downstream axial end of said portion, whereby said flow of liquid and said separate flows of particulate material meet within said mixing chamber in the region of said intersection.

2. A dispenser according to claim 1, wherein:

the liquid inlet means and the nozzle holder cooperate with each other to define a liquid inlet chamber;

the nozzle holder is clamped between the liquid inlet means and the abutment means to prevent leakage from the liquid inlet chamber around the nozzle holder.

3. A dispenser according to claim 1, wherein:

the inlet nozzle is arranged so as to direct liquid along an axis which is parallel to a reference axis which, itself, is parallel to the central axis through the mixing chamber; and the outlet means comprise an outlet nozzle and convergent flow restrictor which are both in coaxial alignment with the central axis through the mixing chamber.

4. A dispenser according to claim 2, wherein:

each inlet nozzle is arranged so as to direct liquid along an axis which is parallel to a reference axis which, itself, is parallel to the central axis through the mixing chamber; and the outlet means comprise an outlet nozzle and convergent flow restrictor which are both in coaxial alignment with the central axis through the mixing chamber.

5. A dispenser according to claim 3 or claim 4, comprising a controllable supply means for metering the feed of particulate abrasive material to the supply chamber.

6. A dispenser according to claim 1, wherein:

the nozzle holder supports a plurality of inlet nozzles which are arranged so as to direct liquid along intersecting axes which are angularly inclined, in the same sense, to radial planes containing the central axis through the mixing chamber; and locking means are provided for preventing rotation of the nozzle holder.

7. A dispenser according to claim 2, wherein:

the nozzle holder supports a plurality of inlet nozzles which are arranged so as to direct liquid along intersecting axes which are angularly inclined, in the same sense, to radial planes containing the central axis through the mixing chamber; and locking means are provided for preventing rotation of the nozzle holder.

8. A dispenser according to claim 6 or claim 7, wherein:

the number of passages for the particulate abrasive material is the same as the number of inlet nozzles;

the passages for the particulate abrasive material are centered on first equiangularly spaced radial planes containing the central axis of the mixing chamber; and the first equiangularly spaced radial planes are respectively angularly spaced from second equiangularly spaced radial planes which also contain the central axis of the mixing chamber and on which the inlet nozzles are centered.

9. A dispenser according to claim 1, wherein:

said mixing chamber has an axially elongated cylindrical shape of substantially constant diameter, the upstream end of said cylindrical mixing chamber being defined by a surface on said nozzle holder;

said inlet nozzle mounted in said nozzle holder communicating with said mixing chamber through a discharge opening located directly in said upstream end of said cylindrical mixing chamber; and each said passage communicates with said mixing chamber through a respective said entry port located in the cylindrical side surface of said mixing chamber at a point substantially axially downstream of said upstream end of said mixing chamber.

* * * * *